United States Patent [19]

Flam et al.

[11] Patent Number: 4,926,145

[45] Date of Patent: May 15, 1990

[54] RADIAL POWER COMBINER/DIVIDER WITH MODE SUPPRESSION

[75] Inventors: Richard P. Flam, Doylestown; Jonathan P. MacGahan, Yardley, both of Pa.

[73] Assignee: Flam & Russell, Inc., Horsham, Pa.

[21] Appl. No.: 285,537

[22] Filed: Dec. 16, 1988

[51] Int. Cl.[5] ..... H01P 5/12

[52] U.S. Cl. ..... 333/125; 333/137; 333/251

[58] Field of Search ..... 330/287, 295; 333/125, 333/127, 136, 137, 251

[56] References Cited

U.S. PATENT DOCUMENTS

| | | | |
|---|---|---|---|
| 2,512,468 | 6/1950 | Percival . | |
| 3,290,682 | 12/1966 | Ajioka | 333/137 X |
| 3,496,497 | 2/1970 | Conning . | |
| 3,634,790 | 1/1972 | Turtletaub . | |
| 3,662,285 | 5/1972 | Rucker | 333/125 X |
| 4,091,334 | 5/1973 | Sechi | 330/287 |
| 4,238,747 | 12/1980 | Harp et al. | 333/251 X |
| 4,263,568 | 4/1981 | Nemit | 333/127 |
| 4,641,107 | 2/1987 | Kalokitis | 330/286 |
| 4,673,899 | 6/1987 | Jesperson et al. | 333/137 |

*Primary Examiner*—Paul Gensler

*Attorney, Agent, or Firm*—Howson & Howson

[57] ABSTRACT

In a radial power combiner/divider in which radial slots are provided for suppression of undesired modes, certain undesired modes which are not adequately suppressed by the radial slots are allowed to be propagated in a central coaxial transmission line and suppressed therein by means of longitudinal slots in the outer conductor. In an alternative embodiment, the central transmission line of the combiner/divider is in the form of a circular waveguide, and the suppression means comprises thin, spaced coaxial cylinders of dissipative material.

14 Claims, 6 Drawing Sheets

RADIAL POWER COMBINER/DIVIDER WITH MODE SUPPRESSION

BRIEF SUMMARY OF THE INVENTION

This invention relates to power combiner/dividers, and more particularly to a combiner/divider having improved mode suppression. The invention has particular utility in radar, satellite communications and in similar applications where power amplification is carried out by means of multiple solid state amplifying devices.

The term "combiner/divider", as used herein, should be understood as encompassing a device used exclusively as a combiner or exclusively as a divider, as well as a device used simultaneously, or at different times, for both purposes.

For many microwave and millimeter wave applications, solid state amplifying devices are preferred over vacuum tube devices such as travelling wave tubes because of their greater reliability. Where substantial quantities of rf power are required, the outputs of multiple solid state devices are combined by means of a power combiner. The power combiner has several advantages. It allows solid state devices, which individually have comparatively small power-handling capabilities, to be combined satisfactorily, in relatively large numbers, in order to produce a power output approaching the sum of the outputs of the individual devices. It also permits "fail soft" operation. That is, even if one or two of many combined devices fail, the overall power output of the combiner is not significantly degraded. This latter feature is particularly advantageous in satellite communications or in unattended radar applications, where it may be difficult or impossible to replace the devices.

One form of power combiner/divider which is particularly advantageous is the "radial power combiner/divider". In general, a radial power combiner/divider is a device in which a plurality of radial ports are coupled through a radial transmission line to an axially extending transmission line. In a typical radial combiner/divider, each port has associated with it a single solid state amplifying device. In the case in which the combiner/divider is used solely as a combiner, the solid state devices usually receive their inputs either from a divider, which may be of a design similar to the combiner, or from separate oscillators. The outputs of the solid state devices are coupled to the radial ports, combined in the radial transmission line, and coupled through a cavity of the radial transmission line to the axial transmission line.

The radial combiner/divider may be used with a plurality of single-port solid state devices such as IMPATT diodes known generally as reflection amplifiers. In this case, the combiner/divider is used simultaneously as a combiner and as a divider. A three port isolation device, known as a "circulator" is connected to the axially extending transmission line to direct incoming rf energy from an input port to the transmission line and to direct the output energy of the combiner/divider from the axial transmission line toward an output port. The incoming rf energy is divided in the radial transmission line, fractions being delivered through the radial ports to the reflection amplifiers. The outputs of the reflection amplifiers are directed back through the radial ports to the radial transmission line, and from there, through the axial transmission line to the circulator. The amplified signal is derived at the output port of the circulator.

One of the problems with a radial power combiner/divider is that its radial transmission line can propagate undesired higher order modes such as the $E_{1,0}$, $E_{2,0}$, and $E_{3,0}$ modes in addition to the desired $E_{0,0}$ mode. These undesired modes can arise by reason of inaccuracies in the construction of the combiner, or by reason of unbalanced conditions caused, for example, by partial or complete failure of one or more of the amplifying devices. These undesired modes can have deleterious effects on the performance of the combiner/divider, including degradation in the amplitude and phase balance among the radial ports and an increase in the overall combining or dividing loss.

A conventional method of suppressing undesired modes in a radial power combiner/divider is to provide an array of radial slots in one or both of the bottom and top walls of the radial transmission line, i.e. the walls to which the axis of the axial transmission line is perpendicular. Since the current flow lines associated with the $E_{0,0}$ mode are radial, they are substantially unaffected by the slots. However, the current flow lines associated with the higher order modes, $E_{m,0}$, where $m \geqq 1$, are tangential to the mode cut-off circle of radius $m\lambda/2\pi$, and therefore intersect the radial slots so that the mode energy is coupled to dissipative material located behind the slots (outside the radial transmission line) or to resistive terminations connected across the slots.

By coupling undesired higher-order modes through the radial slots to a dissipative material, the deleterious effects which would occur if these higher-order modes were allowed to exist in the cavity are reduced.

The higher-order modes can be tolerated to some extent in some types of combiner/dividers. However they tend to cause instability and interfere seriously with the proper operation of an amplifier comprising a number of reflection amplifiers connected to a common transmission line through a radial combiner/divider.

Conventional practice has been to attempt to eliminate all of the undesired higher order modes using the radial slots in one or both of the upper and lower walls of the radial transmission line. The slots in the conventional combiner/divider extend almost to the central axis of the device in order to eliminate, to the extent possible, the lowest order modes ($m=1$ and $m=2$) of the undesired modes while propagating the $m=0$ mode. However, for a radial slot to be effective in eliminating a particular mode, it must extend inwardly beyond the cut-off circle for that mode, i.e. the circle whose radius is $m\lambda/2\pi$, preferably by a distance of at least one quarter wavelength. It can readily be seen that this is impossible for the $m=1$ mode. Even in the case of the $m=2$ mode, the cut-off circle is so small as to give rise to mechanical problems as well as impedance matching problems at the center of the radial transmission line, where it is coupled to the axial line.

The principal objects of this invention are to provide a radial power combiner/divider in which energy corresponding to undesired higher order modes in the radial transmission line, including the $m=1$ and $m=2$ modes, is effectively absorbed; and to accomplish this while avoiding mechanical and impedance matching problems. Another object of the invention is to provide a simple and effective combiner/divider which avoids instability problems when used in combination with a plurality of reflection amplifiers.

The foregoing objects are achieved in accordance with the invention by designing the radial and axial transmission lines so that, instead of attempting to couple the lowest order undesired mode through the radial slots to a dissipative material, its energy is propagated, along with that of the desired mode (m=0) to the axial transmission line, and absorbed by means of a mode-selective dissipative structure located along the axial transmission line.

Other objects, features and advantages of the invention will be apparent from the following detailed description.

DETAILED DESCRIPTION

Figure 1:
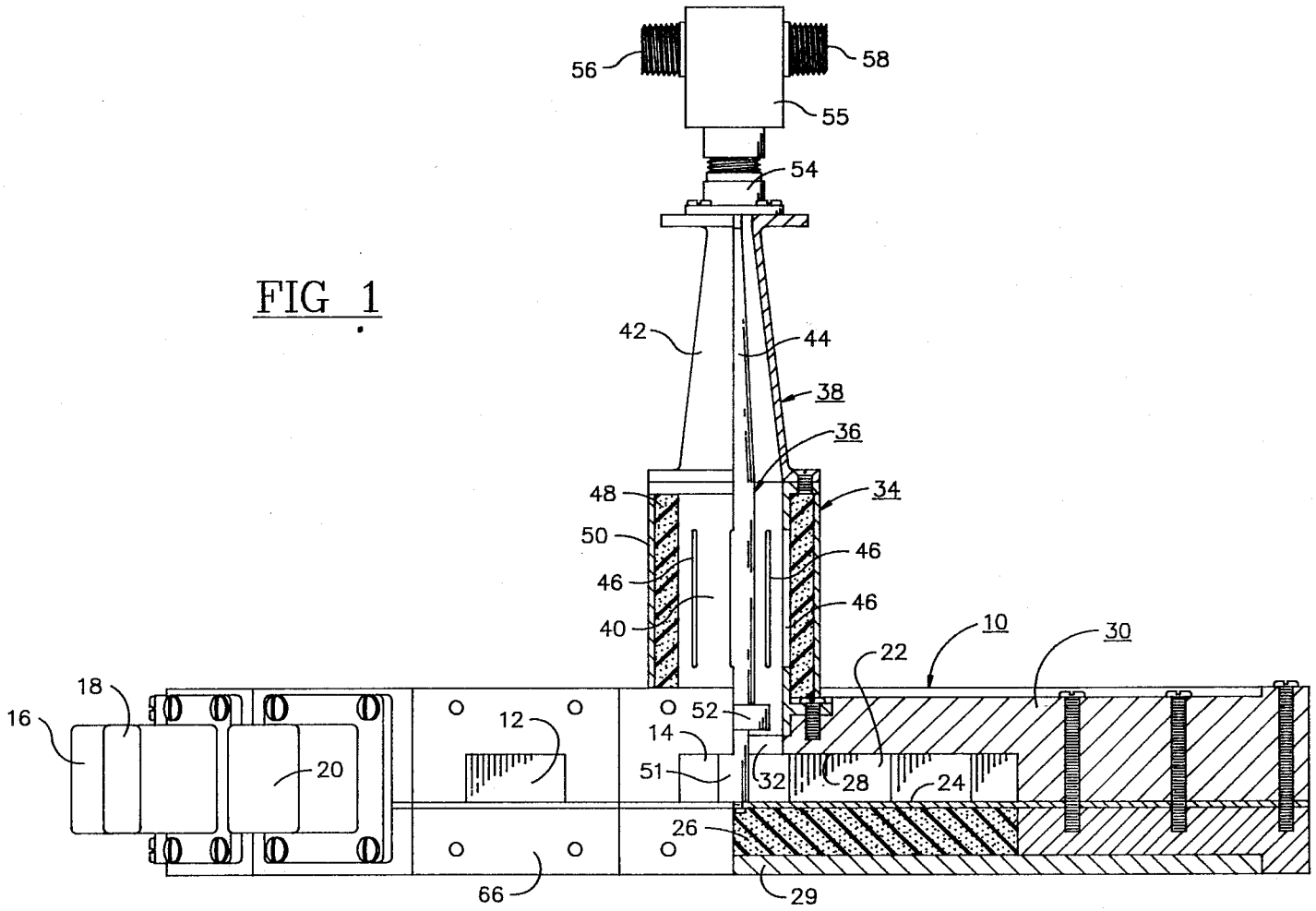
FIG. 1 is a side elevation, partly in axial section, of an amplifier comprising a radial combiner/divider in accordance with the invention.

The amplifier apparatus of FIG. 1 comprises a radial transmission line generally indicated at 10, having a number of ports at its periphery, including ports 12 and 14. In the complete amplifier, each of the ports has connected to it a reflection amplifier. Three such reflection amplifiers are shown at 16, 18 and 20. The ports in the periphery of the radial transmission line lead, through radially extending rectangular waveguides, to a central cavity 22. The central cavity is bounded by a slotted floor plate 24, underneath which is a layer 26 of carbon-loaded sponge rubber or a similar dissipative material such as ferrite-loaded silicone rubber or ferrite-loaded ceramic. A shield 29 is provided underneath the dissipative layer. Internal wall 28 of block 30 is parallel to floor plate 24 and forms the upper boundary of the central cavity. A central opening 32 is provided in the upper boundary 28 of the cavity. To this central opening is connected a coaxial transmission line 34, which extends perpendicular to floor plate 24 and the plane of upper boundary 28. This coaxial transmission line 34 has a center conductor 36, which extends upwardly from the floor plate through an outer conductor 38. The outer conductor 38 is made up of a cylindrical lower section 40 and a tapered upper section 42. The portion 44 of center conductor 36 which is inside tapered section 42 is also tapered. The cylindrical section 40 of the outer conductor is provided with longitudinally extending slots 46, and is surrounded by a cylinder 48 of dissipative material similar to the material of layer 26. The dissipative cylinder is surrounded by a shield 50.

The lowermost part 51 of the center conductor is secured to the floor plate 24 by one or more screws. The center conductor has an enlargement 52 located a short distance above opening 32 for impedance matching. Alternatively, a cone can be used as an impedance matching device.

The flanged upper end of the coaxial transmission line is provided with a connector 54 to which is attached a circulator 55. The circulator has an input connector 56 and an output connector 58. It is a well-known three-port device, which directs input rf energy entering a first port to a second port while isolating this input rf energy from the third port, and directs output rf energy entering the second port to the third port while isolating this output rf energy from the first port. In the case of circulator 55, rf energy appearing at the input port 56 is directed down the coaxial transmission line 34, while rf energy travelling up the transmission line is directed to output port 58.

Figure 2:
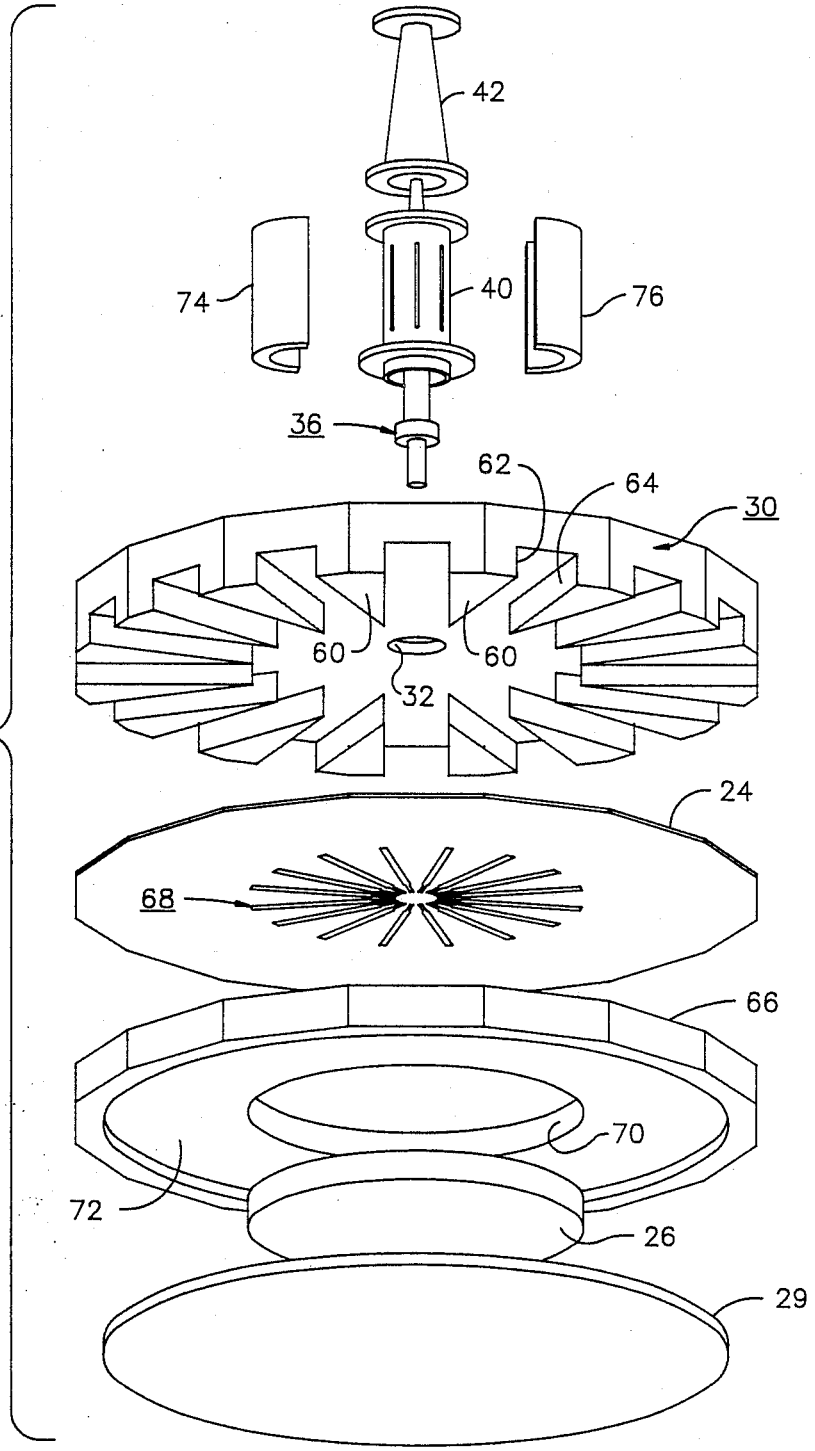
FIG. 2 is an exploded isometric view of the radial combiner/divider of FIG. 1.

The manner in which the combiner/divider portion of the amplifier apparatus is constructed is illustrated in the exploded view of FIG. 2. The peripheral ports and the radial waveguides are formed by floor plate 24 and block 30, which is machined so that it has sixteen outer faces and sixteen wedge-shaped elements 60. The opposed side walls, e.g. side walls 62 and 64, of adjacent wedge-shaped elements are parallel to each other.

Floor plate 24 is clamped between block 30 and block 66. An array 68 of radial slots in floor plate 24 is in register with a hole 70 in block 66, and hole 70 receives dissipative layer 26. Shield 29 is secured in a recess 72 in the underside of block 66. The slotted cylindrical section 40 of the outer conductor of the coaxial transmission line is secured to the upper side of block 30, and to the tapered section of the outer conductor, by flanges. Because of the flanges, the dissipative cylinder surrounding section 40 preferably consists of two parts 74 and 76.

Figure 3:
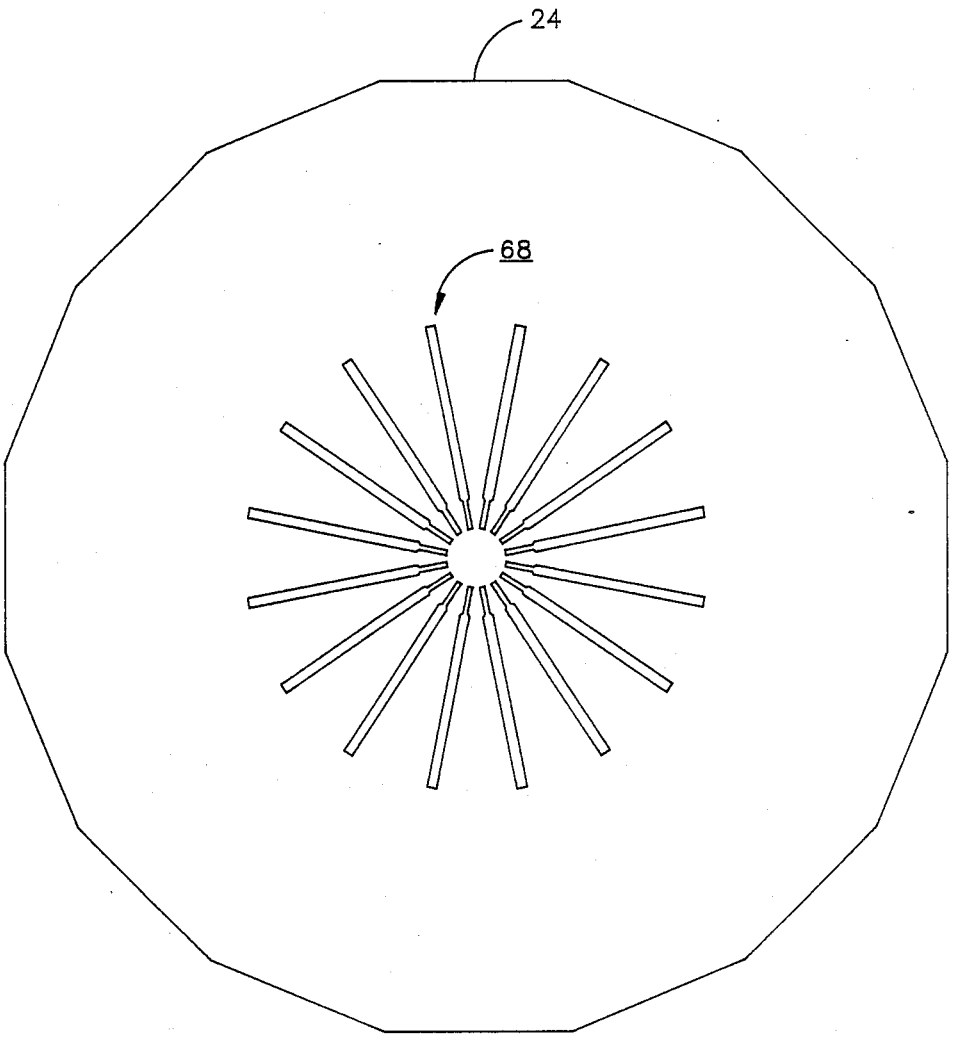
FIG. 3 is a top plan view of a plate forming the floor of the combiner/divider, showing the mode-controlling radial slots.

As shown in FIG. 3, plate 24 has sixteen slots disposed symmetrically about the center of the plate. So that the slots can extend inwardly as far as possible without intersecting, their inner ends are narrowed. However, the major portions of the slots are made wider in order to achieve effective coupling of higher order modes through the slots to the dissipative layer 26 underneath plate 24.

Figure 4:
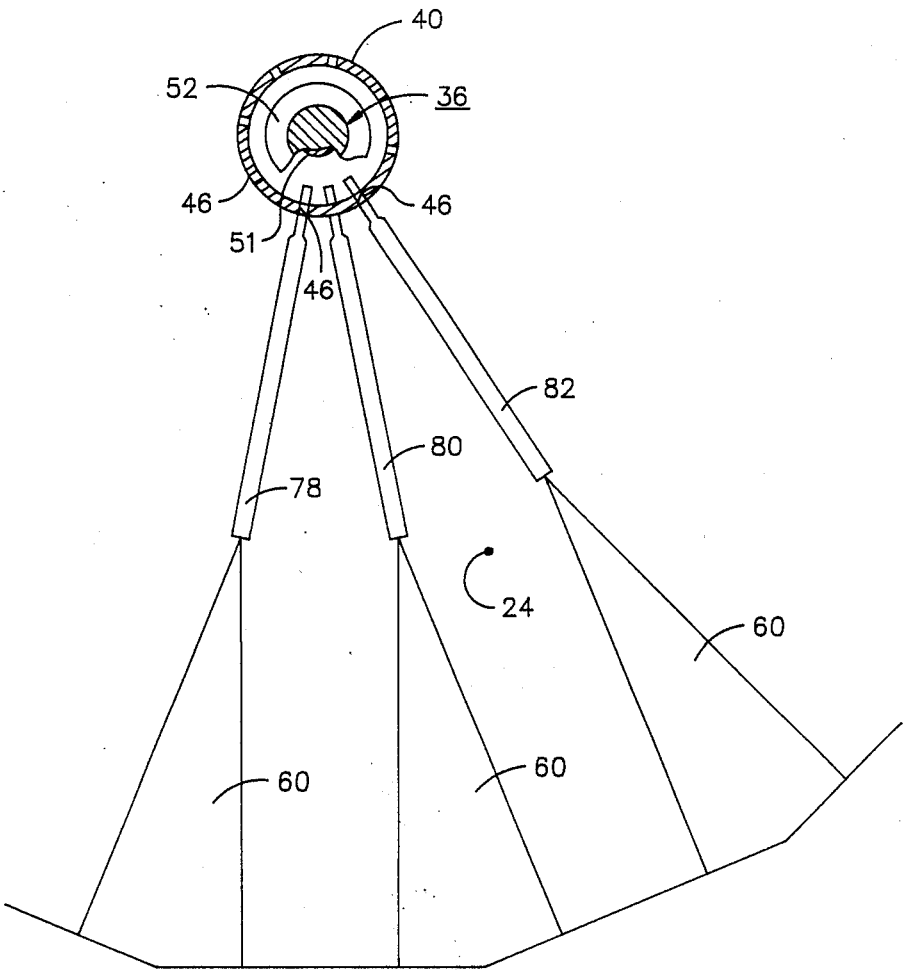
FIG. 4 is a fragmentary sectional view showing the relationship of the radial mode controlling slots to the axial transmission line, the latter being in the form of a coaxial line having longitudinal slots in its outer conductor as part of a mode-selective structure.

FIG. 4 shows in detail the relationship of the radial slots to the input rectangular waveguides which extend inwardly from the radial ports to the central cavity. It also shows the relationship of the input rectangular waveguides to the elements of the coaxial transmission line. The slots 78, 80 and 82 in floor plate 24 extend inwardly from the apices of the wedge-shaped elements 60 toward the center of plate 24. The inner ends of these radial slots closely approach the lower end of part 51 of the center conductor. In the embodiment shown, there are twice as many radial slots in plate 24 as there are longitudinal slots in section 40 of the outer conductor. The longitudinal slots 46 are preferably symmetrical on the outer conductor and arranged so that each longitudinal slot 46 is aligned with the apex of one of the wedge-shaped elements 60. Therefore, the central structure appears to each input rectangular waveguide as the mirror image of the central structure as seen by each next adjacent input rectangular waveguide.

The longitudinal slots 46 are also preferably at least twice as long as the inside diameter of the outer conductor section 40.

While the radial slots are shown as extending inwardly from the apices of the wedge-shaped elements, this is not necessarily the case. However, regardless of the relationship of the radial slots to the wedge-shaped elements, it is desirable to position the longitudinal slots 46 so that they are in alignment with the apices of wedge-shaped elements.

The number of longitudinal slots is not necessarily half the number of radial slots. For example, the number of longitudinal slots could be equal to the number of radial slots. In any case, it is preferred to have the longitudinal slots disposed with respect to the wedge-shaped elements so that the central structure is essentially the same for each input rectangular waveguide.

In the embodiment of FIGS. 1–4, where a coaxial line is used as the central axial transmission line, the key to effective suppression of the lowest order undesired modes in the radial transmission line is to design the coaxial transmission line so that it propagates energy corresponding to these undesired modes. Thus, the lower section of the coaxial transmission line is enlarged, as shown in FIG. 1. If the undesired modes in the radial transmission line have indices $m=1$ and $m=2$ ($E_{1,0}$ and $E_{2,0}$ for example), the dimensions of the lowermost section of the axial transmission line are chosen to permit propagation of the $TE_{1,1}$ and $TE_{2,1}$ modes along with the desired TEM mode. The longitudinal slots 46 extend parallel to the current flow lines for the TEM mode and consequently have no significant effect on the propagation of that mode in the coaxial line. The current flow lines for the $TE_{1,1}$ and $TE_{2,1}$ modes, however follow a helical path on the inner wall of the outer conductor section 40, and are therefore coupled by slots 46 to the dissipative cylinder 48. The upper portion of the coaxial line therefore can be gradually narrowed in order to connect the line to the circulator or whatever other device is connected to the line, without transmitting energy in the $TE_{1,1}$ and $TE_{2,1}$ modes.

Typically, $TE_{1,1}$ and $TE_{2,1}$ are the first and second higher order modes to propagate as the dimensions of the coaxial line are increased. $TM_{0,1}$, $TM_{1,1}$ and $TM_{2,1}$, which require larger dimensions, are preferably not propagated in the coaxial line.

Enlargement of the lower section of the coaxial line produces a severe impedance mismatch and large junction capacitances at the location at which the coaxial line meets the radial transmission line. These conditions are compensated by matching structures, specifically the enlarged portion 52 of the inner conductor of the coaxial line.

Figure 5:
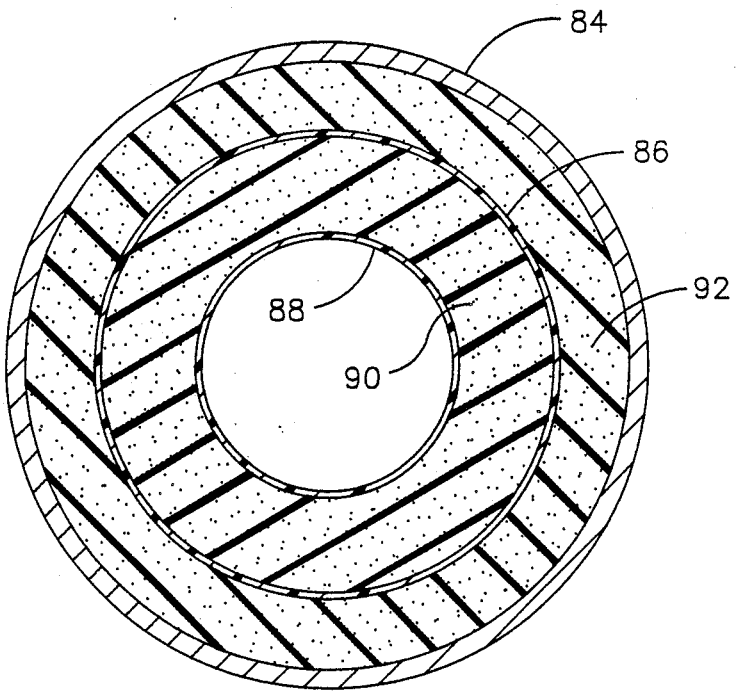
FIG. 5 is a radial section of a cylindrical waveguide used as an axial transmission line in accordance with the invention, the figure showing an alternative form of mode-selective dissipative structure.
Figure 6:
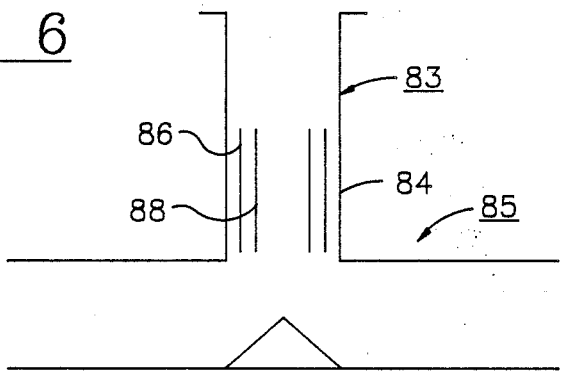
FIG. 6 is a schematic axial section of a radial power combiner/divider having a waveguide as its axial transmission line and using the mode-selective dissipative structure of FIG. 5.

The axial transmission line of the combiner/divider can be a circular waveguide rather than a coaxial transmission line. In a circular waveguide, the $TM_{0,1}$ mode is the mode which is excited by the desired $E_{0,0}$ mode in the radial transmission line. In a circular waveguide, the $TM_{0,1}$ mode is the only mode for which the E field lines are radial. Thus, it is possible to filter out other modes in the waveguide by means of a mode-selective structure which comprises a series of thin coaxial cylinders of dissipative material. FIGS. 5 and 6 show a circular waveguide usable as an axial transmission line 83 in a combiner/divider 85, as an alternative to a coaxial transmission line. The circular waveguide comprises a metal cylinder 84 having within it a pair of dissipative coaxial cylinders 86 and 88, each comprising a film of polyester resin coated with a thin layer of metal such as Nickel or Chromium. Cylinders 86 and 88 are held in place by layers 90 and 92 of dielectric material such as polyethylene. Of course, many alternative materials can be used in the waveguide of FIG. 5, and the number of film cylinders may be only one or greater than two.

The $m=1$ mode in the radial transmission line excites the $TE_{1,1}$ mode in the circular waveguide. The E field lines for this mode, and for other modes as well (except for $TM_{0,1}$) are disposed so that, at any instant, at least some of the lines are tangential to the dissipative film cylinders. Consequently, the E field sets up currents in the cylinders and energy of the undesired modes is absorbed. The axial lengths of the dissipative cylinders are preferably at least twice the internal diameter of the waveguide.

In the cylindrical waveguide, the $TE_{1,1}$ mode will always be propagated if the desired $TM_{0,1}$ mode is propagated. Thus, if the $TE_{1,1}$ mode is the only undesired mode the energy of which is to be absorbed by the dissipative material in the waveguide, it is unnecessary to enlarge the diameter of the waveguide beyond the diameter necessary to propagate the $TM_{0,1}$ mode. However, if the $TE_{2,1}$ mode is to be absorbed by the dissipative material in the waveguide along with the $TE_{1,1}$ mode, then the waveguide must be enlarged beyond the diameter required to propagate the $TM_{0,1}$ mode. A mode converter (not shown) may be used with the cylindrical waveguide to connect an external device such as a circulator to the desired $TM_{0,1}$ mode and discriminate against any undesired modes which are not absorbed by the dissipative cylinders.

Figure 7:
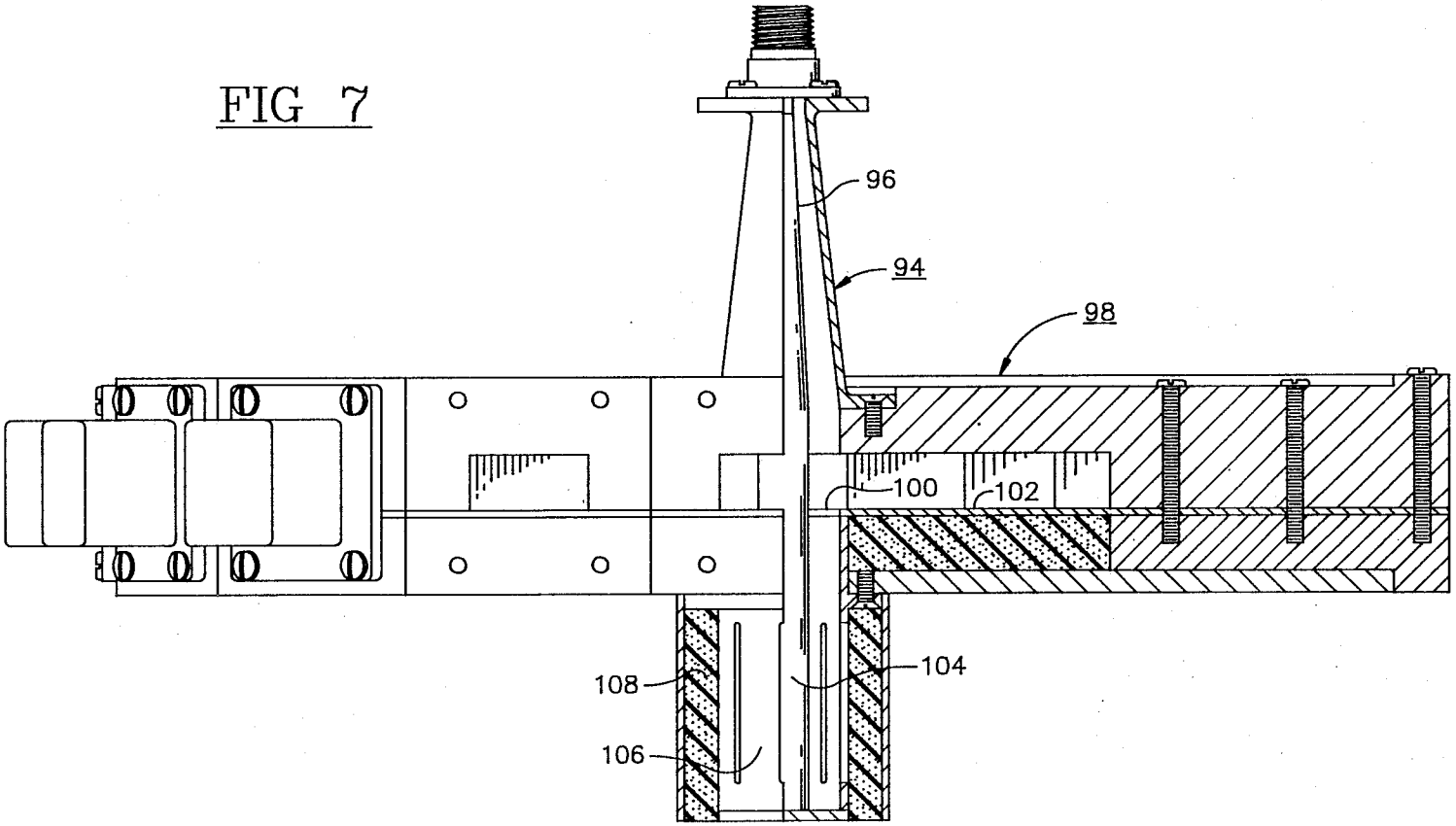
FIG. 7 is a side elevation, partly in axial section of an alternative version of an amplifier using a radial combiner/divider having a coaxial transmission line.

The secondary mode-selective dissipative structure is not necessarily located physically between the radial transmission line and the remote end of the axial transmission line. For example, FIG. 7 shows a radial combiner/divider similar to that shown in FIG. 1 except that the secondary mode-selective structure is located on the opposite side of the radial transmission line from the remote end of the axial transmission line. In FIG. 7, the coaxial transmission line 94 has a central conductor 96 which extends through the center of the radial transmission line 98, and through a hole 100 in the floor plate 102. The lower portion 104 of the center conductor is located within a slotted outer conductor 106 surrounded by a shielded cylinder 108 of dissipative material. The entire secondary mode-selective dissipative structure is therefore located below the radial transmission line. Here again the dimensions of the mode-selective portion of the coaxial line are chosen so as to propagate one or more of the lower order undesired modes, such as $TE_{1,1}$ and $TE_{2,1}$, along with the desired TEM mode. The upper portion of the coaxial transmission line is tapered in order to match the combiner/divider to an input, output or input/output device.

The combiner/divider according to the invention operates by coupling one or more of the lower order undesired modes to the axial transmission line, and then absorbing these undesired modes in the axial line rather than attempting to absorb them by means of radial slots in the radial line. By doing so the combiner/divider effectively reduces or substantially eliminates the undesirable effects of the $m=1$ mode, and in some cases also the $m=2$ mode, without materially impairing the efficiency of the combiner/divider and without introducing a significant insertion loss. The mode suppression means of the invention is particularly advantageous when the combiner/divider is part of an amplifying apparatus using multiple reflection amplifiers.

Many modifications can be made to the invention other than those specifically shown and discussed. For example, the number of radial ports can be varied from the sixteen ports specifically shown, and the primary mode-selective structure in the radial transmission line can take various forms other than the specific array of radial slots with a dissipative layer underneath it, as shown. In the secondary mode-selective structure, the number of slots in the outer conductor of the coaxial line, or the number of dissipative cylinders in the case of a circular waveguide can be varied. Still other modifications which will occur to those skilled in the art can be made without departing from the scope of the invention as defined in the following claims.

We claim:

1. In a radial power combiner/divider in which a plurality of radial ports are coupled through a radial transmission line to a central, axially extending transmission line, the improvement comprising means permitting energy corresponding to a desired mode in the radial transmission line to be transmitted from the radial transmission line to the axially extending transmission line along with energy corresponding to at least one undesired mode in said radial transmission line, and mode-selective dissipative means, coupled directly to said axially extending transmission line so that it could suppress wave energy being propagated in said axially extending transmission line even if the radial transmission line were not present, said mode-selective dissipative means suppressing, in said axially extending transmission line, a mode corresponding to the energy of said at least one undesired mode.

2. A radial power combiner/divider according to claim 1 in which said axially extending transmission line is a coaxial transmission line having an inner conductor and an outer wall, and said mode-selective dissipative means comprises a plurality of axially elongated slots in said outer wall.

3. A radial power combiner/divider according to claim 1 in which said axially extending transmission line is a waveguide having a circular cylindrical wall and said mode-selective dissipative means comprises a set of cylinders of dissipative material located within the waveguide and arranged coaxially therewith, said cylinders being radially spaced from one another and from said wall.

4. A radial power combiner/divider according to claim 1 in which the axially extending transmission line is a coaxial line having a first and second sections, said mode-selective dissipative means being directly coupled to said first section, and said second section being tapered down in a direction away from said first section.

5. A radial power combiner/divider according to claim 1 in which the axially extending transmission line is a coaxial line having first and second sections on opposite sides of the radial transmission line, the mode-selective dissipative means being directly coupled to said first section, and said coaxial line having an output port at an end of said second section remote from the radial transmission line.

6. In a radial power combiner/divider in which a plurality of radial ports are coupled through a radial transmission line to a central, axially extending transmission line, and having primary mode-selective dissipative means directly coupled to the radial transmission line, the improvement comprising means permitting energy corresponding to a desired mode in the radial transmission line to be transmitted from the radial transmission line to the axially extending transmission line along with energy corresponding to at least one undesired mode in said radial transmission line, and secondary mode-selective dissipative means coupled directly to said axially extending transmission line so that it could suppress wave energy being propagated in said axially extending transmission line even if the radial transmission line were not present, said mode-selective dissipative means suppressing, in said axially extending transmission line, a mode corresponding to the energy of said at least one undesired mode.

7. A radial power combiner/divider according to claim 6 in which the radial transmission line has a wall substantially perpendicular to the axis of the axially extending transmission line and in which said primary mode-selective dissipative means comprises an array of radially extending slots in said wall.

8. A radial power combiner/divider according to claim 6 in which said axially extending transmission line is a coaxial transmission line having an inner conductor and an outer wall, and said secondary mode-selective dissipative means comprises a plurality of axially elongated slots in said outer wall.

9. A radial power combiner/divider according to claim 6 in which said axially extending transmission line is a waveguide having a circular cylindrical wall and said secondary mode-selective dissipative means comprises a set of cylinders of dissipative material located within the waveguide and arranged coaxially therewith, said cylinders being radially spaced from one another and from said wall.

10. A radial power combiner/divider according to claim 6 in which the axially extending transmission line is a coaxial line, in which the desired mode in the radial transmission line is the $E_{0,0}$ mode, and in which the means permitting transmission of energy corresponding to said desired mode along with energy corresponding to at least one undesired mode permits energy corresponding to the $E_{1,0}$ mode to be transmitted from the radial transmission line to the axially extending transmission line.

11. A radial power combiner/divider according to claim 6 in which the axially extending transmission line is a coaxial line, in which the desired mode in the radial transmission line is the $E_{0,0}$ mode, and in which the means permitting transmission of energy corresponding to said desired mode along with energy corresponding to at least one undesired mode permits energy corresponding to the $E_{1,0}$ and $E_{2,0}$ modes to be transmitted from the radial transmission line to the axially extending transmission line.

12. A radial power combiner/divider according to claim 6 in which the axially extending transmission line is a coaxial line having a first and second sections, the secondary mode-selective dissipative means being directly coupled to said first section, and said second section being tapered down in a direction away from said first section.

13. A radial power combiner/divider according to claim 6 in which the axially extending transmission line is a coaxial line having first and second sections on opposite sides of the radial transmission line, the secondary mode-selective dissipative means being directly coupled to said first section, and said coaxial line having an output port at an end of said second section remote from the radial transmission line.

14. In an amplifier apparatus comprising a plurality of reflection amplifiers and a radial power combiner/divider having a plurality of radial ports by which the reflection amplifiers are coupled through a radial transmission line to a centrally located, axially extending transmission line, in which the radial transmission line has a wall substantially perpendicular to the axis of the axially extending transmission line and a primary mode-selective dissipative means comprising radially extending slots in said wall, the improvement comprising means permitting energy corresponding to a desired mode in the radial transmission line to be transmitted from the radial transmission line to the axially extending transmission line along with energy corresponding to at least one undesired mode in said radial transmission line, and a secondary mode-selective dissipative means coupled directly to said axially extending transmission line so that it could suppress wave energy being propagated in said axially extending transmission line even if the radial transmission line were not present, said mode-selective dissipative means suppressing, in said axially extending transmission line, a mode corresponding to the energy of said at least one undesired mode.

* * * * *